United States Patent [19]

Hughes et al.

[11] 3,992,071

[45] Nov. 16, 1976

[54] PROCESSES FOR ACTIVATING S-1 CATHODE

[75] Inventors: Frederick R. Hughes, Lancaster; Robert C. Crissman, Leola, both of Pa.

[73] Assignee: The United States of America as represented by the Secretary of the Army, Washington, D.C.

[22] Filed: Apr. 1, 1975

[21] Appl. No.: 564,197

[52] U.S. Cl. ..... 316/18; 316/5; 316/6; 316/26

[51] Int. Cl.[2] ..... H01J 9/02

[58] Field of Search ..... 316/1, 5, 6, 8, 10, 316/11, 12, 13, 18, 24, 26; 313/94, 365

[56] References Cited

UNITED STATES PATENTS

| | | | |
|---|---|---|---|
| 1,904,895 | 4/1933 | Campbell | 316/5 |
| 2,045,418 | 6/1936 | Simms | 316/6 |
| 3,372,967 | 3/1968 | Hughes | 316/5 |
| 3,658,400 | 4/1972 | Heluy | 313/94 |
| 3,838,304 | 9/1974 | McDonie | 313/94 |

*Primary Examiner*—Richard B. Lazarus
*Attorney, Agent, or Firm*—Nathan Edelberg; John E. Holford; Robert P. Gibson

[57] ABSTRACT

A method of forming an S-1 (silver-oxide-cesium) cathode is provided wherein the tube preparation includes two bakeout periods punctuated by an oxygen flush and the cathode activation includes a special cathode current pulsation technique.

1 Claim, 2 Drawing Figures

PROCESSES FOR ACTIVATING S-1 CATHODE

BACKGROUND OF INVENTION

Photocathodes are the heart of all types of electronic light detection and surveillance systems. One of the most popular of these devices is the image intensifier tube. This device converts a barely visible image and/or a near infrared invisible light image to a very bright visible light image. The photocathode converts the ambient light image to an electronic image which is then amplified by vacuum tube and/or solid state structures. The S-1 photocathode is preferred for intensifier tubes because of its strong response to the near infrared portion of the spectrum, which constitutes the major portion of available radiation in most low level ambient light environments. Commercially available cathodes of this type have a sensitivity of approximately of 25 microamperes/lumen when used on a lime glass and Koval sealing borosilicate glass, which becomes the light transmitting substrate. Narrow band sensitivities of 3 to 3.5 microamperes/lumen are achieved when the above cathode is used with a 2540 filter.

SUMMARY OF THE INVENTION

An object of the present invention is to provide an improved S-1 photocathode with greater sensitivity than commercially available types. An additional object is to provide a method of fabricating more sensitive photocathodes in a tube structurally equivalent to commercially available tubes, which is thus compatible with the processing equipment currently available for such tubes.

BRIEF SUMMARY OF DRAWING

The invention is best understood with reference to the accompanying drawing wherein.

DESCRIPTION OF THE INVENTION

Figure 1:
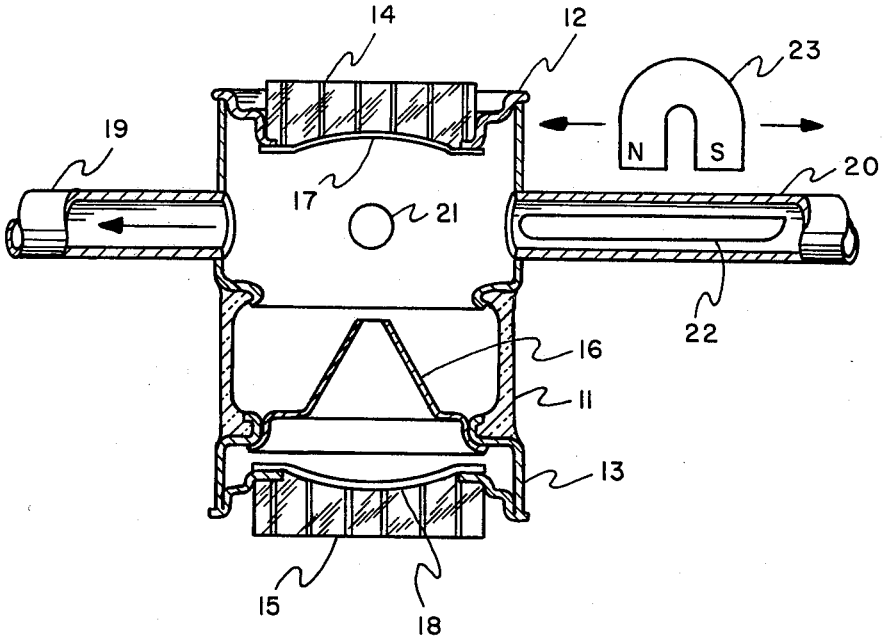
FIG. 1 shows a typical image intensifier tube and portions of associated fabricating equipment during the formation and activation process for the photocathode.

The image intensifier tube shown in FIG. 1 consists of a cylindrical glass body 11 with separate cylindrical thin-wall metal end frames 12 and 13 into which are sealed glass fiber optic face plates 14 and 15. The end piece 13 is used as an anode and includes a truncated thin-wall metal cone 16 which focusses traveling electrons within the tube. These electrons are emitted by a photocathode 17 mounted on the inner surface of faceplate 14. Most of these same electrons impinge upon a phosphor screen coated on the inner face of the faceplate 15 after passing through the opening at the top of cone 16. Energy to accelerate the electrons is provided by a source of d. c. electrical potential connected between the metal end frames in the conventional manner. The inner surface of the glass body 11 may be coated with an inert opague insulation material compatible with the constituents of the photocathode and screen.

Initially the cathode end frame 12 includes a number of integral tubulations such as 19, 20 and 21. These tabulations are connected to vacuum pumps, gas generators, etc. used in cleaning the inside of the tube during processing of the photocathode. Slugs of high melting point materials coated with low melting point cathode materials such as silver or cesium on a magnetic base may be inserted in the tubulation prior to their evacuation. These slugs can then be moved in and out of the tube and heated inductively by an external source 23 of magneto-motive force. Alternatively, tungsten wires (not shown) can be sealed through the walls of the glass tube body 11 and coated or alloyed with similar cathode materials, which can be evaporated by a heating current passed through the wire. Whichever element is used the plating material is positioned during evaporation, so that the heat and/or electrical gradients inside the tube will urge the freed atoms (or ions) toward the cathode.

Figure 2:
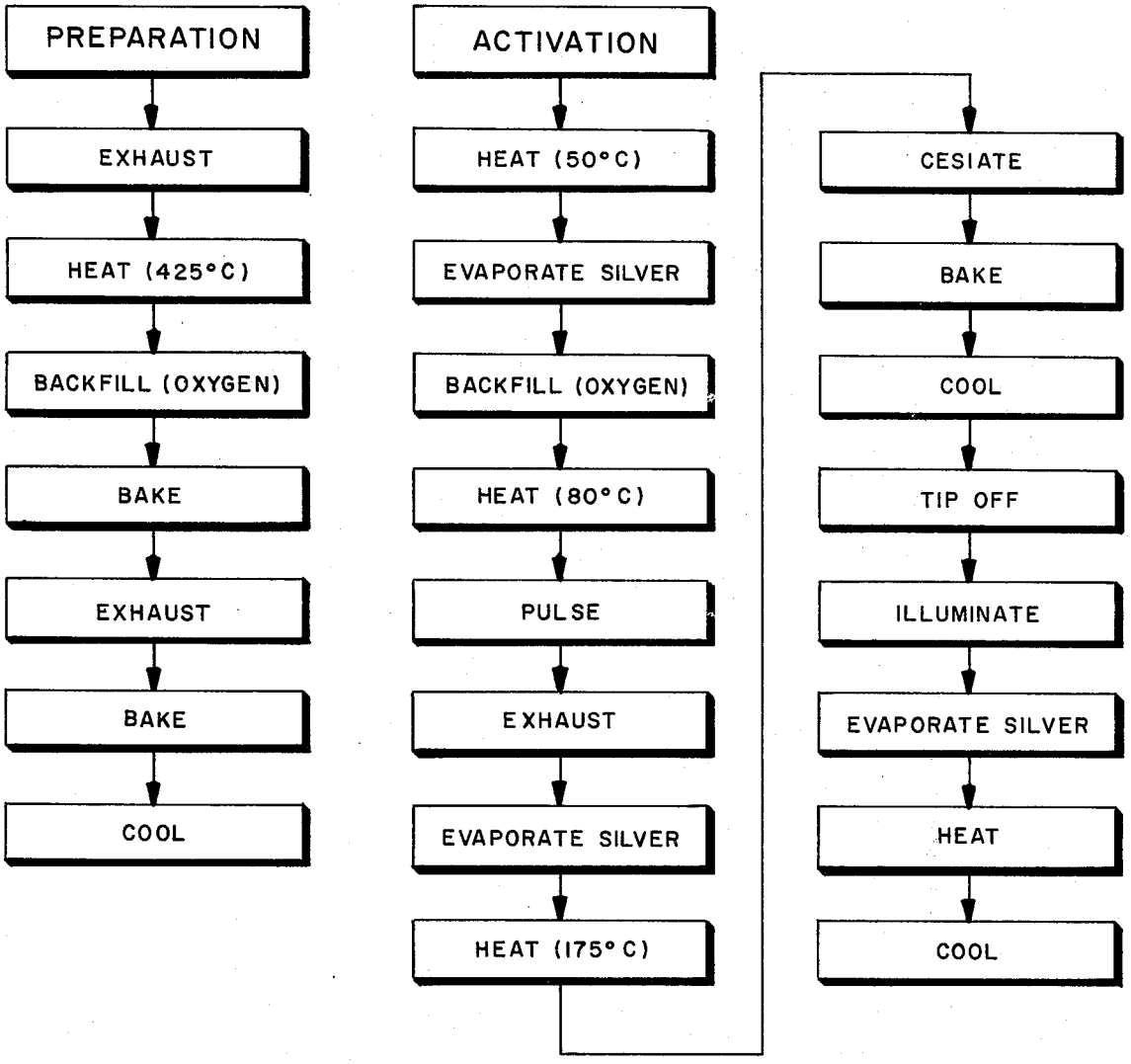
FIG. 2 shows a flow diagram of the preparation and activation process.

After the plating devices have been installed, the pumps and gas generators have been connected to the tubulations 19, 20 and 21, and suitable sources of electrical, magnetic and heat energy have positioned around the tube (less cathode 17) with suitable monitoring devices; the cathode is formed and the tube is completed as indicated in FIG. 2 by the following steps:

1. Pump tube down to a pressure of 5 microns of mercury;
2. Heat entire tube to 425° Centigrade;
3. Backfill with oxygen to a pressure of 500 microns for 10 minutes;
4. Pump down to a pressure of 5 microns and bake for 110 minutes at 425° Centigrade;
5. Cool to room temperature;
6. Heat cathode faceplate to 50° Centigrade;
7. Evaporate silver on the inner surface of the cathode faceplate until its light transmission to any broadband visible source is reduced to 85%, this may be achieved by premeasuring the silver or by external reflectance measurements, either of which has been precorrellated with a transmission measurement on an isolated faceplate;
8. Backfill with oxygen to a pressure of 225 microns and raise the temperature of the faceplate to 80° Centigrade, hold until light transmission decreases to a minimum;
9. Apply current pulses of 550 volts 26 milliamperes each pulse lasting one second with a pause of one second between pulses and a five second pause between each group of five pulses, until light transmission increases to 98–100%;
10. Pump the tube down to 5 microns pressure and cool to 50° Centigrade;
11. Evaporate additional silver until light transmission is reduced to 95%;
12. Heat faceplate to 175° Centigrade;
13. Apply a normal operating potential between the cathode and the anode and monitor the thermionic current produced;
14. Cesiate the cathode until a peak thermionic current is obtained, shutting down the cesium generator at that peak;
15. Continue to bake at 175° Centigrade until a second peak is obtained;
16. Cool to room temperature;
17. Tip-off tubulations and any removable material generators other than the silver one;
18. Illuminate the cathode sufficiently to produce a measurable photocurrent;
19. Evaporate silver until a peak photocurrent is attained and falls off to 50% of the peak value;

20. Heat entire tube sufficiently to produce a gradually rising temperature until the photocurrent reaches a peak, then quickly cool to room temperature;

21. If silver generator is removable type tip-off, otherwise tube is completed at step 19. Table I shows a comparison of the sensitivities.

The present process differs from previous ones in most of its steps, but most notable is the long vacuum bake-out in the preparation stage, before the cathode is deposited and withholding the use of "glow discharge" (current pulses) until after the first silvering rather than in the preparation stage. Only one post exhaust (after tip-off) resilvering step is used instead of two. Obviously slight variations of the process will occur to those skilled in the art, but the present invention is limited only as specified in the claims which follow.

TABLE I

| State of Art | | Improved Schedule | |
|---|---|---|---|
| Overall Sensitivity (μa/lumen) | IR Sensitivity (μa/lumen through a 2540 filter) | Overall Sensitivity (μa/lumen) | IR Sensitivity (μa/lumen through a 2540 filter) |
| 25.5 | 3.3 | 48.0 | 6.6 |
| 26.5 | 3.5 | 42.5 | 5.1 |
| 23.0 | 3.15 | 43.0 | 5.5 |
| 26.5 | 3.7 | 44.0 | 5.5 |
| 22.5 | 2.9 | 45.5 | 6.2 |
| 23.0 | 2.9 | 41.5 | 5.1 |
| 26.5 | 3.5 | 43.0 | 5.8 |
| 22.0 | 3.0 | 40.0 | 5.2 |
| 26.5 | 3.5 | 45.0 | 5.4 |
| 24.5 | 3.3 | 46.5 | 6.0 |

We claim:

1. A process for making an S-1 cathode in an image intensifier tube with a tube preparation and activation stages including the following steps:

Exhaust tube to 5 microns pressure;
Heat to 425° Centigrade;
Backfill with oxygen to 500 microns pressure;
Bake for 10 minutes;
Exhaust to 5 microns pressure;
Bake for 110 minutes;
Cool to room temperature;
Heat faceplate to 50° Centigrade;

Evaporate silver on faceplate until light transmission thereof is reduced to 85%;
Backfill with oxygen to 225 microns pressure;
Heat to 80° Centigrade until light transmission of faceplate is a minimum;
Apply normal polarity current pulses between anode and cathode of 550 volts and 26 milliamperes for one second intervals separated by at least one second until light transmission by faceplate reaches 98–100% of original value;
Exhaust to 5 microns pressure;
Evaporate silver until light transmission of faceplate decreases 95%;
Heat tube to 175° Centigrade;
Using thermionic current as monitor cesiate cathode until peak current is obtained;
Shut off cesion generator and continue to bake at 175° Centigrade until second peak is reached;
Cool to room temperature;
Tip-off all removable processing units except the silver evaporation unit;
With a normal operating potential between the anode and cathode illuminate the cathode sufficiently to induce a measureable photocurrent;
Evaporate silver until the photocurrent peaks and falls off 50%;
Heat entire tube until the photocurrent reaches a peak value; and
Cool to room temperature.

* * * * *